US009352334B2

(12) United States Patent
Rieger et al.

(10) Patent No.: US 9,352,334 B2
(45) Date of Patent: May 31, 2016

(54) APPARATUS FOR CONTINUOUS SEPARATION OF MAGNETIC CONSTITUENTS AND CLEANING OF MAGNETIC FRACTION

(75) Inventors: Reinhold Rieger, Mutterstadt (DE); Imme Domke, Jersey City, NJ (US); Alexej Michailovski, Ludwigshafen (DE); Dennis Lösch, Altrip (DE); Stephan Deuerlein, Ludwigshafen (DE); Igor Shishkov, Mannheim (DE); David F. Blackwood, Long Valley, NJ (US)

(73) Assignees: BASF SE, Ludwigshafen (DE); BASF Corporation, Florham Park, NJ (US)

( * ) Notice: Subject to any disclaimer, the term of this patent is extended or adjusted under 35 U.S.C. 154(b) by 220 days.

(21) Appl. No.: 13/983,089

(22) PCT Filed: Jan. 31, 2012

(86) PCT No.: PCT/EP2012/051540

§ 371 (c)(1),
(2), (4) Date: Oct. 8, 2013

(87) PCT Pub. No.: WO2012/104292

PCT Pub. Date: Aug. 9, 2012

(65) Prior Publication Data

US 2014/0027383 A1 Jan. 30, 2014

Related U.S. Application Data

(60) Provisional application No. 61/438,278, filed on Feb. 1, 2011.

(30) Foreign Application Priority Data

Feb. 1, 2011 (EP) ..... 11152938

(51) Int. Cl.
*B03C 1/30* (2006.01)
*B03C 1/28* (2006.01)

(52) U.S. Cl.
CPC .. *B03C 1/30* (2013.01); *B03C 1/288* (2013.01)

(58) Field of Classification Search
CPC ..... B03C 1/30; B03C 1/288
See application file for complete search history.

(56) References Cited

U.S. PATENT DOCUMENTS 3,489,280 A 1/1970 Israelson et al.
4,663,029 A 5/1987 Kelland et al.

(Continued)

FOREIGN PATENT DOCUMENTS

DE 1160130 B 12/1963
EP 0520917 A1 12/1992

(Continued)

OTHER PUBLICATIONS

U.S. Appl. No. 61/315,028, Michailovski et al.

(Continued)

*Primary Examiner* — David A Reifsnyder
(74) *Attorney, Agent, or Firm* — Drinker Biddle & Reath LLP

(57) ABSTRACT

The present invention relates to an apparatus for the separation of magnetic constituents from a dispersion comprising these magnetic constituents and nonmagnetic constituents, comprising at least one loop-like canal (5) through which a dispersion flows having at least two inlets (1, 2) and at least two outlets (3, 4), further comprising at least one magnet (6) that is moveable alongside the canal (5), wherein the canal (5) is arranged relative to gravity in a way that nonmagnetic constituents are assisted to go into at least the one first outlet (3) (stream I) by sedimentation and by the current of the dispersion and magnetic constituents are forced into at least one second outlet (4) (stream II) by magnetic force against a current of flushing water. Furthermore, the present invention relates to a process for the separation of magnetic constituents from a dispersion comprising these magnetic constituents and nonmagnetic constituents.

15 Claims, 8 Drawing Sheets

(56) References Cited

U.S. PATENT DOCUMENTS

| | | | | |
|---|---|---|---|---|
| 4,941,969 | A | 7/1990 | Schonert et al. | |
| 6,149,014 | A | 11/2000 | Mankosa et al. | |
| 8,372,290 | B2 | 2/2013 | Domke et al. | |
| 8,377,313 | B2 | 2/2013 | Domke et al. | |
| 8,475,661 | B2 | 7/2013 | Ratto et al. | |
| 8,486,270 | B2 | 7/2013 | Rieger et al. | |
| 2010/0300941 | A1 | 12/2010 | Domke et al. | |
| 2010/0307982 | A1 | 12/2010 | Domke et al. | |
| 2011/0120919 | A1 | 5/2011 | Domke et al. | |
| 2011/0120954 | A1 | 5/2011 | Domke et al. | |
| 2011/0168618 | A1 | 7/2011 | Danov et al. | |
| 2011/0272623 | A1 | 11/2011 | Domke et al. | |
| 2011/0303772 | A1 | 12/2011 | Michailovski et al. | |
| 2012/0000857 | A1 | 1/2012 | Domke et al. | |
| 2012/0132032 | A1 | 5/2012 | Domke et al. | |
| 2012/0165588 | A1 | 6/2012 | Dehn et al. | |
| 2012/0211403 | A1 | 8/2012 | Rieger et al. | |
| 2013/0334107 | A1 * | 12/2013 | Rieger et al. | 209/10 |

FOREIGN PATENT DOCUMENTS

| | | | |
|---|---|---|---|
| EP | 1524038 | A1 | 4/2005 |
| GB | 1029002 | A | 5/1966 |
| SU | 1240451 | A1 | 6/1986 |
| SU | 1470341 | A1 | 4/1989 |
| WO | WO-98/06500 | A1 | 2/1998 |
| WO | WO-2009010422 | A1 | 1/2009 |
| WO | WO-2009030669 | A2 | 3/2009 |
| WO | WO-2009065802 | A2 | 5/2009 |
| WO | WO-2010007075 | A1 | 1/2010 |
| WO | WO-2010007157 | A1 | 1/2010 |
| WO | WO-2010031617 | A1 | 3/2010 |

OTHER PUBLICATIONS

U.S. Appl. No. 61/367,883.

International Search Report for PCT/EP2012/051540 mailed May 23, 2012.

* cited by examiner

APPARATUS FOR CONTINUOUS SEPARATION OF MAGNETIC CONSTITUENTS AND CLEANING OF MAGNETIC FRACTION

PRIORITY

Priority is claimed as a national stage application, under 35 U.S.C. §371, to PCT/EP2012/051540, filed Jan. 31, 2012, which claims priority to European Application No. 11152938.4, filed Feb. 1, 2011, and U.S. Provisional Application No. 61/438,278 filed Feb. 1, 2011. Each disclosure of the aforementioned priority applications is incorporated herein by reference in its entirety.

BACKGROUND

The present invention relates to an apparatus for the separation of magnetic constituents from a dispersion comprising these magnetic constituents and nonmagnetic constituents, comprising at least one loop-like canal through which a dispersion flows having at least two inlets and at least two outlets, further comprising at least one magnet that is moveable alongside the canal, wherein the canal is arranged relative to gravity in a way that nonmagnetic constituents are assisted to go into at least the one first outlet (stream I) by sedimentation and by the current of the dispersion and magnetic constituents are forced into at least one second outlet (stream II) by magnetic force against a current of flushing water. Furthermore, the present invention relates to a process for the separation of magnetic constituents from a dispersion comprising these magnetic constituents and nonmagnetic constituents, wherein this dispersion flows through at least one loop-like canal having at least two inlets and at least two outlets, further comprising at least one magnet that is moveable alongside the canal, wherein the canal is arranged relative to gravity in a way that, nonmagnetic constituents are assisted to go into the at least one first outlet by sedimentation and by the current of the dispersion and magnetic constituents are forced into at least one second outlet by magnetic force against a current of flushing water. In addition, the present invention relates to the use of an apparatus as mentioned above for separating magnetic constituents from a dispersion comprising these magnetic constituents and nonmagnetic constituents.

Processes and apparatuses for the separation of magnetic constituents from a dispersion comprising these and nonmagnetic constituents are already known to the skilled artisan.

WO 2010/031617 A1 discloses a device for separating ferromagnetic particles from a suspension, wherein this device comprises a tubular reactor and a plurality of magnets which are arranged outside the reactor, the magnets being moveable along at least a part of the length of the reactor up to the vicinity of a particle extractor by means of rotary conveyor. The canal is a linear tube and is not loop-like. The cleaning of the magnetic fraction is not described.

U.S. Pat. No. 6,149,014 discloses a mill magnet separator and method for separating, wherein the separator comprises a wet drum magnetic separator capable of treating, removing tramp metal from the full flow discharge of a grinding mill having a feed box which provides overflow capacity. Separation of magnetic particles of the mentioned dispersion is achieved by fixed magnets which are arranged at the inner side of a rotating drum. The mentioned document does not disclose any specific arrangement of the apparatus in respect of gravity.

EP 0 520 917 A1 discloses a method and apparatus for magnetic separation. The apparatus comprises a magnetic separator with fixed, low intensity magnets and a rotated drum, which is surrounded by a wall to get a long magnetic separation zone. The mentioned document does not disclose any arrangement of the apparatus in respect of gravity. Flushing along the separated magnetic particles is described, but no digging up the magnetic layer.

U.S. Pat. No. 3,489,280 discloses a magnetic separator having field shaping poles. The separator according to this document is a drum-like separator, wherein fixed magnets are arranged at the inside of the drum which is partly surrounded by a wall through the sobuilt channel the dispersion to be treated flows. Further magnets are arranged at the opposite side of this channel. The mentioned document does not disclose any arrangement of the apparatus in respect of gravity and no flushing of the magnetic separated fraction is documented.

SU 1240451 A1 discloses a separator for the separation of magnetic particles from a dispersion comprising these and nonmagnetic particles by a disk-like magnetic separator, comprising fixed magnets at the outside of the disks. A canal is formed at the inside of the disks and the dispersion to be treated flows through this canal. The magnets are located at alternating positions at both sides of the disk, so that the magnetic layer is dug up by running from one side of the canal to the other side. The magnetic fraction is washed out of the disk-like canal by a clean fluid, but no washing of the magnetic fraction is documented. The mentioned document does not disclose any arrangement of the apparatus in respect of gravity.

SU 1470341 A1 discloses a separator for separating magnetic particles from dispersants comprising these and nonmagnetic particles by a drum separator, wherein this drum separator comprises a long way along the drum in which a magnetic field is applied to the dispersion to be separated in order to increase yield and efficiency of magnetic separation.

WO 98/06500 discloses an apparatus and method for separating particles. This apparatus includes means for generating a rotating magnetic field such as a rotating magnetic drum. The canal through which the dispersion to be separated flows is in direct neighborhood to the magnets, wherein it is loop-like or linear. The separation is done by causing a rotation to the particles to be separated, what occurs to coarse particles, and to use this rotation as force to separate the magnetizable particles. It is not disclosed in said document that the whole reactor shall be arranged in respect to gravity in a way to improve separation of magnetic and nonmagnetic particles.

EP 1524038 A1 discloses a separator for separating magnetic particles from dispersants comprising these and nonmagnetic particles by a loop-like separator that is using magnetic forces to separate magnetic fraction assisted by centrifugal and gravity forces, wherein gravity forces are working across the flow direction due to the horizontal location of the loop and do not efficiently separate nonmagnetic constituents from the way of magnetic constituents. It is not disclosed to clean the magnetic fraction in any way.

The processes and apparatuses according to the prior art in general show the disadvantage that specific arrangements of the magnets are necessary in order to support the movement of the magnetic particles into at least one outlet in order to separate these magnetic particles from the dispersion. With these specific arrangements of the magnets, the maximal ranges of magnetic force cannot be exploited.

Furthermore, the processes known from the prior art generally have the disadvantage that only an unsatisfactory separating action is achieved since for example nonmagnetic constituents like gangue are also incorporated in the magnetic constituents adhering to the magnetic drum. These nonmagnetic constituents are in this way likewise separated off from the dispersion. The nonmagnetic constituents remain in the material of value after the magnetic constituents have been separated off and in the later work-up of the ore mineral, for example by smelting, leading to unfavorable space-time yields and thus to increased costs of the overall process. The use of a rotating magnetic roller does not, according to the prior art, make it possible for the proportion of nonmagnetic constituents to be effectively reduced.

It is therefore an object of the present invention to provide an apparatus and process for separating magnetic constituents from a preferably aqueous dispersion comprising these magnetic constituents and nonmagnetic constituents, in which a very small proportion of nonmagnetic constituents is separated off, for example by attachment to the magnetic constituents, together with the magnetic constituents comprising, for example, the desired ore mineral so as to increase the efficiency of the process.

Furthermore, it is advantageous if a very small proportion of nonmagnetic constituents is present in the fraction to be separated off, since, particularly in the separation of naturally occurring ores, the nonmagnetic constituents comprise essentially oxidic compounds which in a work-up of the ore mineral by smelting are obtained as slag and have an adverse effect on the smelting process. It is therefore also an object of the present invention to provide a process for separating naturally occurring ores so that a very small amount of slag is obtained in a subsequent smelting process.

The object of the present invention is to provide an apparatus and process for separating magnetic particles from a dispersion comprising these magnetic particles and nonmagnetic particles which give rise to an improvement in respect of yield and quality of the separated particles. In addition, an apparatus and process shall be provided with which it is possible to separate large amounts of material.

These objects are achieved by an apparatus for the separation of magnetic constituents from a dispersion comprising these magnetic constituents and nonmagnetic constituents, comprising at least one loop-like canal through which the dispersion flows having at least two inlets and at least two outlets, further comprising at least one magnet that is moveable alongside the canal, wherein the canal is arranged relative to gravity in a way that nonmagnetic constituents are assisted to go into the at least one first outlet by sedimentation and by the current of the dispersion and the magnetic constituents are forced into at least one second outlet by magnetic force against a current of flushing water.

The second outlet is preferably only an outlet for solid magnetic constituents, but preferably not for fluids like dispersion or flushing water with flushed non-magnetic constituents. The flushing water is added at the at least second outlet of the loop-like canal, where only magnetic constituents are moved by the at least one magnet. In a preferred embodiment, the application of a flushing water stream is performed to rearrange the magnetic fraction, in order to free therein stored nonmagnetic constituents.

The above-mentioned objects are further achieved by a process for the separation of magnetic constituents from a dispersion comprising these magnetic constituents and nonmagnetic constituents, wherein this dispersion flows through at least one loop-like canal having at least two inlets and at least two outlets, further comprising at least one magnet that is moveable alongside the canal, wherein the canal is arranged relative to gravity in a way that nonmagnetic constituents are assisted to go into at least one first outlet by sedimentation and by the current of the dispersion and magnetic constituents are forced into at least one second outlet by magnetic force against a current of flushing water.

The apparatus according to the present invention is explained in detail in the following.

The apparatus of the invention serves to separate magnetic constituents from an aqueous dispersion comprising these magnetic constituents and nonmagnetic constituents. The magnetic constituents can be originally magnetic by themselves or can be magnetized afterwards by the attachment of magnetic particles to non-magnetic particles.

According to the invention, the process can in general be employed for separating all magnetic constituents from nonmagnetic constituents that form dispersion, preferably in water.

In a preferred embodiment, the process of the invention serves to separate aqueous dispersions which originate from the work-up of naturally occurring ores.

In a further preferred embodiment of the process of the invention, the aqueous dispersion to be separated originates from a process for separating at least one first material from a mixture comprising this at least one first material and at least one second material, with the at least two materials being separated from one another by treating the mixture in aqueous dispersion with at least one magnetic particle, resulting in the at least one first material and the at least one magnetic particle agglomerating and thus forming the magnetic constituents of the aqueous dispersion and the at least one second material and the at least one magnetic particle not agglomerating so that the at least one second material preferably forms the nonmagnetic constituents of the aqueous dispersion.

The agglomeration of at least one first material and at least one magnetic particle to form the magnetic constituents in general occurs as a result of attractive interactions between these particles.

According to the invention, it is possible, for example, for said particles to agglomerate because the surface of the at least one first material is intrinsically hydrophobic or is hydrophobicized by treatment with at least one surface-active substance, if appropriate additionally. Since the magnetic particles likewise either themselves have a hydrophobic surface or are hydrophobicized, if appropriate additionally, said particles agglomerate as a result of the hydrophobic interactions. Since the at least one second material preferably has a hydrophilic surface, the magnetic particles and the at least one second material do not agglomerate. A process for formation these magnetic agglomerates is described, for example, in WO 2009/030669 A1. For all details of this process, reference is expressly made to this publication.

For the purposes of the present invention, "hydrophobic" means that the corresponding particle can have been hydrophobicized subsequently by treatment with the at least one surface-active substance. It is also possible for an intrinsically hydrophobic particle to be additionally hydrophobicized by treatment with the at least one surface-active substance.

"Hydrophobic" means, for the purposes of the present invention, that the surface of a corresponding "hydrophobic substance" or a "hydrophobicized substance" has a contact angle of >90° with water against air. "Hydrophilic" means, for the purposes of the present invention, that the surface of a corresponding "hydrophilic substance" has a contact angle of <90° with water against air.

The formation of magnetic agglomerates, i.e. the magnetic constituents which can be separated off by the process of the invention, can also occur via other attractive interactions, for example via the pH-dependent zeta potential of the corresponding surfaces, see, for example, the International publications WO 2009/010422 and WO 2009/065802. Further methods for attaching magnetic particles and particles to be separated off include application of bifunctional molecules, like for example described in WO2010/007075. Another method for attaching magnetic particles and particles to be separated off include application of molecules being hydrophobic or hydrophilic depending on the temperature, like for example described in WO2010/007157.

In a preferred embodiment of the process of the invention, the at least one first material which together with magnetic particles forms the magnetic constituents is at least one hydrophobic metal compound or coal and the at least one second material which forms the nonmagnetic constituents is preferably at least one hydrophilic metal compound.

The at least one first material is particularly preferably a metal compound selected from the group consisting of sulfidic ores, oxidic and/or carbonate-comprising ores, for example azurite [$Cu_3(CO_3)_2(OH)_2$] or malachite [$Cu_2$—[$(OH)_2|CO_3$]]), or noble metals to which a surface-active compound can bind selectively to produce hydrophobic surface properties.

The at least one second material is particularly preferably a compound selected from the group consisting of oxidic and hydroxidic compounds, for example silicon dioxide $SiO_2$, silicates, aluminosilicates, for example feldspars, for example albite $Na(Si_3Al)O_8$, mica, for example muscovite $KAl_2$—[$(OH,F)_2AlSi_3O_{10}$], garnets (Mg, Ca, $Fe^{II}$)$_3$(Al, $Fe^{III}$)$_2$ ($SiO_4$)$_3$, $Al_2O_3$, FeO(OH), $FeCO_3$ and further related minerals and mixtures thereof. This at least one hydrophilic metal compound is itself nonmagnetic and also does not become magnetic by attachment of at least one magnetic particle. The at least one hydrophilic metal compound thus forms, in a preferred embodiment, the nonmagnetic constituents of the dispersion to be separated.

Examples of sulfidic ores which can be used according to the invention are, for example, selected from the group of copper ores, consisting of covellite CuS, chalcopyrite (copper pyrite) $CuFeS_2$, bornite $Cu_5FeS_4$, chalcocite (copper glance) $Cu_2S$ and mixtures thereof, and also other sulfides such as molybdenum(IV) sulfide and pentlandite ($NiFeS_2$).

Suitable oxidic metal compounds which can be used according to the invention are preferably selected from the group consisting of silicon dioxide $SiO_2$, silicates, aluminosilicates, for example feldspars, for example albite $Na(Si_3Al)O_8$, mica, for example muscovite $KAl_2$—[$(OH,F)_2AlSi_3O_{10}$], garnets (Mg, Ca, $Fe^{II}$)$_3$(Al, $Fe^{III}$)$_2$($SiO_4$)$_3$ and further related minerals and mixtures thereof.

Accordingly, with the apparatus of the invention preferably ore mixtures which have been obtained from mine deposits and which have been treated with appropriate magnetic particles are treated.

In a preferred embodiment of the process of the invention, the mixture comprising at least one first material and at least one second material is present in the form of particles having a size of from 100 nm to 200 μm; see, for example, U.S. Pat. No. 5,051,199. Preferred ore mixtures have a content of sulfidic materials of at least 0.01% by weight, preferably 0.5% by weight and particularly preferably at least 3% by weight.

Examples of sulfidic minerals which are present in the mixtures which can be treated according to the invention are those mentioned above. In addition, sulfides of metals other than copper can also be present in the mixtures, for example sulfides of iron, lead, zinc or molybdenum, i.e. FeS/$FeS_2$, PbS, ZnS or $MoS_2$. Furthermore, oxidic compounds of metals and semimetals, for example silicates or borates, or other salts of metals and semimetals, for example phosphates, sulfates or oxides/hydroxides/carbonates and further salts, for example azurite [$Cu_3(CO_3)_2(OH)_2$], malachite [$Cu_2[(OH)_2(CO_3)]$], barite ($BaSO_4$), monazite ((La—Lu)$PO_4$), can be present in the ore mixtures to be treated according to the invention. Further examples of the at least one first material which is separated off with the apparatus of the invention are noble metals, for example Au, Pt, Pd, Rh etc., which can be present in the native state, as alloy or in associated form.

DESCRIPTION

To form the magnetic constituents of the preferably aqueous dispersion to be treated according to the invention, the at least one first material from the abovementioned group is brought into contact with at least one magnetic particle in order to obtain the magnetic constituents by attachment or agglomeration. In general, the magnetic constituents can comprise all magnetic particles known to those skilled in the art.

In a preferred embodiment, the at least one magnetic particle is selected from the group consisting of magnetic metals, for example iron, cobalt, nickel and mixtures thereof, ferromagnetic alloys of magnetic metals, for example NdFeB, SmCo and mixtures thereof, magnetic iron oxides, for example magnetite, maghemite, cubic ferrites of the general formula (I)

$$M^{2+}{}_xFe^{2+}{}_{1-x}Fe^{3+}{}_2O_4 \quad (I)$$

where

M is selected from among Co, Ni, Mn, Zn and mixtures thereof and $x \leq 1$, hexagonal ferrites, for example barium or strontium ferrite $MFe_6O_{19}$ where M=Ca, Sr, Ba, and mixtures thereof. The magnetic particles can additionally have an outer layer, for example of $SiO_2$.

In a particularly preferred embodiment of the present patent application, the at least one magnetic particle is magnetite or cobalt ferrite $Co^{2+}{}_xFe^{2+}{}_{1-x}Fe^{3+}{}_2O_4$ where $x \leq 1$.

In a preferred embodiment, the magnetic particles used in the magnetic constituents are present in a size of from 100 nm to 200 μm, particularly preferably from 1 to 50 μm.

In a second preferred embodiment of the apparatus of the present invention, the magnetic constituents which shall be separated are magnetic particles themselves.

In this, second, embodiment magnetic particles themselves are separated from the dispersion. The magnetic particles which are separated in this second embodiment of the invention are preferably selected from the group of magnetic particles as mentioned above.

This second embodiment of the present invention the apparatus of the invention is preferably used in order to separate magnetic constituents, for example naturally occurring magnetite, from naturally occurring ores, preferably before further work-up of these ores.

The present invention preferably relates to the apparatus according to the present invention, wherein the magnetic constituents are selected from the group consisting of magnetic particles, agglomerates of magnetic particles and nonmagnetic particles and mixtures thereof.

In the preferably aqueous dispersion to be treated in the apparatus according to the invention, the magnetic constituents, i.e. preferably magnetic particles and/or agglomerates of magnetic particle and ore mineral, are generally present in an amount which allows the aqueous dispersion to be transported or conveyed in the apparatus according to the invention.

The preferably aqueous dispersion to be treated according to the invention preferably comprises from 0.01 to 10% by weight, particularly preferably from 0.2 to 3% by weight, very particularly preferably from 0.5 to 1% by weight, in each case based on the total dispersion, of magnetic constituents.

In the preferably aqueous dispersion to be treated with the apparatus according to the invention, the nonmagnetic constituents are generally present in an amount which allows the aqueous dispersion to be transported or conveyed in the apparatus according to the invention. The aqueous dispersion to be treated according to the invention preferably comprises from 3 to 50% by weight, particularly preferably from 10 to 45% by weight, very particularly preferably from 20 to 40% by weight, in each case based on the total dispersion, of nonmagnetic constituents.

According to the invention, a preferably aqueous dispersion is treated in the apparatus according to the invention, i.e. the dispersion medium is essentially water, for example from 50 to 97% by weight, preferably from 55 to 90% by weight, very particularly preferably from 60 to 80% by weight, in each case based on the total dispersion. However, the apparatus can also be applied to nonaqueous dispersions or mixtures of solvents with water.

Thus, further dispersion media, for example alcohols such as methanol, ethanol, propanols, for example n-propanol or isopropanol, butanols, for example n-butanol, isobutanol or tert-butanol, other organic solvents such as ketones, for example acetone, ethers, for example dimethyl ether, methyl tert-butyl ether, mixtures of aromatics such as naphtha or diesel or mixtures of two or more of the abovementioned solvents, can be present in addition to or instead of water. The dispersion media present in addition to water are present in an amount of up to 97% by weight, preferably up to 90% by weight, very particularly preferably up to 80% by weight, in each case based on the total dispersion.

The dispersion that is separated with the apparatus according to the present invention has a solid content of for example 3 to 50% by weight, preferably from 10 to 45%.

The present invention therefore further relates to the apparatus according to the present invention, wherein the dispersion to be treated has a solid content of 3 to 50% by weight.

The amounts indicated for the individual components present in the aqueous dispersion to be treated according to the invention in each case add up to 100% by weight.

In a very particularly preferred embodiment, an aqueous dispersion which does not comprise any further dispersion medium in addition to water is treated with the apparatus of the invention.

Due to its specific and advantageous combination of features, the apparatus of the invention can be advantageously applied to separation processes as mentioned above.

These features are a loop-like canal through which the dispersion flows having at least two inlets and at least two outlets, further comprising at least one magnet that is movable alongside the canal, wherein the canal is arranged relative to gravity in a way that nonmagnetic constituents are assisted to go into the at least one first outlet by sedimentation and by the current of the dispersion and magnetic constituents are forced into at least one second outlet by magnetic force against a current of flushing water.

The second outlet is preferably only an outlet for magnetic constituents, but preferably not for fluids like dispersion or flushing water with flushed non-magnetic constituents. The flushing water is added at the at least second outlet of the loop-like canal, where only magnetic constituents are moved by the at least one magnet. In a preferred embodiment, the application of a flushing water stream is performed to rearrange the magnetic fraction, in order to free therein stored nonmagnetic constituents.

The mentioned single features of the apparatus according to the present invention, and their advantageous combination are explained in detail in the following.

The apparatus of the invention comprises at least one loop-like canal through which the dispersion flows having at least two inlet and at least two outlets.

According to the present invention the wording "canal" describes the body structure of the apparatus. According to the present invention the wording "canal" describes an apparatus, which is, in its easiest embodiment, formed by a tube, e.g. the canal according to the invention has a length that is larger than the breadth or diameter of the canal. The cross-section of the canal can have any suitable shape, for example oval, annular, circular, square, rectangular, irregular or a combination of these shapes, preferably square or rectangular.

The loop-like canal according to the invention is designed to be able to separate magnetic constituents from nonmagnetic constituents in laboratory or industrial scale, preferably industrial scale. According to the present invention, an assembly of canals is defined as a reactor and can have an exemplary volume flow through the reactor of at least 350 $m^3/h$, preferably at least 700 $m^3/h$, particularly preferably at least 1000 $m^3/h$.

According to the invention the canal is formed loop-like. According to the invention "loop-like" describes a canal, which, in a simple embodiment, is formed like a loop. In a preferred embodiment the loop-like canal forms a part of a circular arc, for example at least 90°, preferably at least 120°, more preferably at least 180°, in particular at least 270°, of a circular arc. In a further preferred embodiment of the apparatus according to the present invention, the at least first inlet is present at one end of the loop-like canal and the at least two outlets are present at the other end of the loop-like canal. In a further preferred embodiment, after the first outlet there is the at least second inlet placed to flush the magnetic fraction before it reaches the at least second outlet. With this feature according to the present invention a very efficient and complete separation of magnetic constituents is possible.

The diameter of the loop that is constituted by the loop-like canal can be of any suitable size, for example 0.5 to 5 m, preferably 0.8 to 3.5 m, particularly preferably 1.2 to 2.5 m. With these general and preferred diameters, a length of the loop-like canal, specifically a length of magnetic separation is for example 1.25 to 12.5 m, preferably 2 to 9 m, particularly preferably 3 to 6 m.

Furthermore, the loop-like canal through which the dispersion flows has at least two inlets and at least two outlets. In a preferred embodiment, the loop-like canal through which the dispersion flows has one first inlet through which the dispersion comprising magnetic and nonmagnetic constituents is introduced into the canal, and two outlets. Through the first of these outlets the magnetic constituents are removed from the reactor (stream I). Through the second of these outlets the nonmagnetic constituents are removed from the reactor (stream II). Through one second inlet the flushing water is brought to the current of magnetic constituents to rearrange them and to free the stored nonmagnetic constituents therein. According to the present invention, further inlets and/or outlets may be present.

Inlets and outlets that are present in the reactor of the present invention can be realized according to all embodiments known to the skilled artisan, for example tubings in suitable sizes, for example equipped with pumps, valves, means for controlling and adjusting etc.

The apparatus according to the present invention further comprises at least one magnet that is movable alongside the canal.

The at least one magnet may be installed in a movable fashion on the outside or at the inside of the loop-like canal. The at least one magnet is preferably installed on the outside of the loop-like canal.

In a preferred embodiment, the at least one magnet is installed in a movable fashion on the outside of the loop-like canal. This preferred embodiment serves to move the at least one magnet in the longitudinal direction of the loop-like canal in order to separate the magnetic constituents from the non-magnetic constituents. With the at least one movable magnet the magnetic constituents which are attracted by the magnetic field are likewise moved in the corresponding direction, being the at least one second outlet (stream II).

The apparatus of the invention can be operated by the at least one magnet or the magnetic field produced and the preferably aqueous dispersion to be separated moving in the same direction. In this embodiment, the reactor is operated in concurrent. This embodiment is preferred.

In a further preferred embodiment of the apparatus of the invention, the at least one magnet or the magnetic field produced move in the opposite direction to the preferably aqueous dispersion to be separated. In this preferred embodiment, the apparatus of the invention is operated in countercurrent.

The present invention therefore relates to the apparatus according to the present invention, wherein the flow of the dispersion and the moving direction of the at least one magnet are concurrent.

In the countercurrent mode of operation according to the invention, care should be taken to ensure that movement of the magnetic constituents, preferably as a compact mass, in the direction opposite to the flow of the dispersion to be treated due to the at least one magnet does not occur in the feed line, i.e. the at least one first inlet, for the dispersion to be treated. In this case, blockages could occur in this region.

With the apparatus of the invention, a flow velocity of the aqueous dispersion to be treated of for example ≥200 mm/s, preferably ≥400 mm/s, particularly preferably ≥600 mm/s, is accomplished. These high flow velocities ensure that no blockages occur in the apparatus of the invention, in particular in countercurrent operation.

The magnets used according to the invention can be any magnets known to those skilled in the art, for example permanent magnets, electromagnets and combinations thereof. Permanent magnets are preferred, because the amount of energy that is consumed by the apparatus according to the invention can be decreased essentially, compared to the use of electro magnets. With this preferred embodiment a particular energy saving apparatus and process are obtained.

The at least one magnet is installed in any possible way known to the skilled artisan at the loop-like canal as long as it is movable alongside the canal, for example a rotating device, for example by a conveyor belt, by a rotating drum as holder for the at least one magnet or other rotatable constructions to hold the at least one magnet. In a preferred embodiment the at least one magnet is attached to and moved during operation by a rotating device, preferably by a rotating drum.

The present invention therefore also relates to the apparatus according to the present invention, wherein the at least one magnet is moved during operation by a rotating device, preferably by a rotating drum.

In a preferred embodiment, a multiplicity of magnets is arranged around the loop-like canal. The number of magnets depends on the size of the single magnets and on the size of the loop-like canal. An exemplary number of magnets that are arranged around the loop-like canal is 40, preferably 60.

The polarities of the magnets that are preferably arranged around the loop-like canal can be adjusted in any possible way. For example, all polarities of the magnets can be adjusted in the same direction. According to another embodiment, the polarities of the magnets are adjusted alternately. In a preferred embodiment the magnets are adjusted with an alternating sequence of, for example, each 3 magnets with same direction of polarity followed by, for example, one magnet with alternated polarity.

The velocity of the at least one magnet that is moveable alongside the canal is preferably adjusted in a fixed relation to the flow velocity of the dispersion which contains magnetic and non-magnetic constituents. This relation of velocities of the flow of the dispersion and of the at least one magnet is for example 0.5:1, that means that the velocity of magnets is twice the velocity of the dispersion, preferably the relation is larger, particularly preferably 1:1 to 20:1, more preferably 2:1 to 10:1. For example, the relation is 4:1.

The present invention therefore preferably relates to an apparatus according to the present invention, wherein the relation of velocities of the flow of the dispersion and of the at least one magnet is larger than 0.5:1, particularly preferably 1:1 to 20:1, more preferably 2:1 to 10:1.

The at least one magnet and the loop-like canal are arranged in a way that the gap between the outside wall of the canal and the at least one magnet is suitable to obtain an advantageous magnetic field at a location inside the canal where the magnetic constituents shall be collected, preferably at the inside of the outside wall of the canal. An exemplary gap between the outside wall of the canal and the at least one magnet is minimized to less than 5 mm, preferably less than 2 mm, to use maximum force of the at least one magnet.

To realize those small gaps at the apparatus according to the present invention, preferably at a large scale apparatus, the canal is preferably fixed on a disc, preferably on a circular disc. Further preferred, this disc has a narrow tolerance of diameter. Preferably, this tolerance is smaller than 3 mm, preferably smaller than 1 mm, i.e. that the disc has a diameter that deviates by 1.5 mm, preferably 0.5 mm, from the average diameter at maximum.

The present invention therefore preferably relates to an apparatus according to the present invention, wherein the loop-like canal is build of bowed rectangular tubes and is fixed on a disc having narrow tolerance of diameter.

The canal can be build by any method known to the skilled artisan. For example, the canal can be built by a laser-welding construction on that disc. A preferred embodiment to build that canal is bowing a rectangular tube to form the canal and fixing it on that disc by holding their outside shape in a very narrow tolerance smaller than 3 mm, preferably smaller than 1 mm.

More than one of the discs can be used to staple them by holding the outside shape in a very low tolerance less than 3 mm, preferably less than 1 mm. The equipment to realize this is known to the skilled artisan and could be in the simplest version at least one whole in the disc with well specified tolerance in diameter and position. A preferred embodiment is using equipment to adjust each disc to another. In the simplest way this could be screws that allow the adjustment of one disc to another in each direction.

The distance over that the magnetic forces act to the magnetic constituents is limited by the behaviour of the at least one magnet. An exemplary distance that determines the height of the canal, using low intensity standard magnets could be 80 mm, preferably 60 mm, very particularly preferable 40 mm. Therefore the height of the canal could be in a range of 20 to 100 mm, preferable 40 to 80 mm, for example 65 mm.

As long as the essential features of the apparatus of the invention are complied with, the apparatus of the invention may have any further configuration. In a preferred embodiment it shall be ensured that the preferably aqueous dispersion to be separated has sufficient contact with the at least one magnet installed on the outside of the reactor space or the magnetic field produced by this at least one magnet.

The apparatus according to the present invention can, in general, be made from any material that is known to the skilled artisan to be applicable to such an apparatus, for example non-magnetic materials, preferably non-magnetic stainless steels or nonmagnetic cast iron.

Further details of canals that can be used in accordance with the present invention are known to those skilled in the art and are described, for example, in process engineering textbooks.

The apparatus itself and/or the loop-like canal, according to the invention can in principle be arranged in any orientation which appears suitable to a person skilled in the art and allows a sufficiently high separating power of the process of the invention, as long as the tubular reactor is arranged relative to gravity in a way that nonmagnetic constituents are assisted to go into the at least one first outlet by sedimentation and by the current of the dispersion and magnetic constituents are forced into at least one second outlet by magnetic force against a current of flushing water.

In a preferred embodiment of the present invention, the apparatus and/or the loop-like canal according to the present invention are arranged vertically. According to the present invention, a "vertical arrangement" means that the loop-like canal is arranged in a way that dispersion, which is flowing through the loop-like canal, flows up and down, i.e. vertically, but essentially not from one side to another side, i.e. horizontally.

In general, the individual streams in the apparatus of the invention can be conveyed by gravity and/or by means of the apparatuses known to those skilled in the art, for example pumps.

The present invention therefore preferably relates to the apparatus according to the present invention, wherein the current of the dispersion is accomplished by at least one pump.

The essential feature of the apparatus of the invention that the loop-like canal is arranged relative to gravity in a way that nonmagnetic constituents are assisted to go into the at least one first outlet by sedimentation and by the current of the dispersion and magnetic constituents are forced into at least one second outlet by magnetic force can be accomplished by all provisions known to the skilled artisan. In a preferred embodiment of the apparatus according to the invention, the loop-like canal is placed in a way that the closed end of the loop is pointing up, whereas the open end of the loop is pointing down. In a preferred embodiment, the at least one inlet and the at least two outlets are present at the open end of the loop.

In a further preferred embodiment of the apparatus according to the present invention, the loop-like canal is arranged vertically with the open end of the loop at the bottom.

According to the present invention, the position of the loop is preferably defined by the position of the at least first outlet, which is defined by the edge between this at least first outlet and the canal leading the magnetic constituents to the at least second outlet, as for example shown in FIG. 8. This edge is marked in FIG. 8 by a yellow point. The vertical placed loop has is preferably rotated in a way that sedimented nonmagnetic constituents are going from the wall, where they are sedimented, directly to the at least one first outlet (stream I). Taking the horizontal line between this edge and the centre of the vertical loop as a reference)(=0°, the loop can be rotated in both directions (clockwise=negative values; counter clockwise=positive values) to realise these conditions.

In a further preferred embodiment, the loop is rotated laterally along its perpendicular, preferably in radial direction, by −90° to 45°, preferably −45° to 30°, most preferable −30° to 15°. This rotation angle is correlated with the geometrical design of the at least first outlet and the geometrical design of the canal leading to the at least second outlet.

The present invention therefore preferably relates to the apparatus according to the present invention, wherein the position of the edge between the at least first outlet and the canal leading the magnetic constituents to the at least second outlet is rotated laterally along its perpendicular by −90° to +45°, preferably −45° to +30°, most preferably −30° to +15°.

According to the invention a single apparatus as explained above can be used in order to separate magnetic constituents from a dispersion comprising magnetic constituents and nonmagnetic constituents.

In a preferred embodiment of the present invention, more than one canal according to the present invention can be arranged and operated in parallel. This means that the dispersion to be separated is flowing through more than one canal according to the invention at the same time. In a preferred embodiment at least two canals are arranged and operated in parallel.

The present invention therefore preferably relates to an apparatus according to the present invention, wherein at least two canals are arranged and operated in parallel. In a further preferred embodiment at least 30, particularly preferably 100, further preferably at least 200, canals according to the invention are arranged and operated in parallel.

A person having ordinary skill in the art does know how these canals are connected, in order to have them arranged and operated in parallel. In a preferred embodiment all at least two outlets of all canals present are connected in each case to give at least two common outlets. In a further preferred embodiment all at least two inlets of all apparatuses present are connected in each case to give at least two common inlets. The skilled artisan knows how these connections shall be accomplished. For example, in order to have comparable pressure at all locations in the apparatus formed by more than one canal according to the invention, the diameter of common inlets and/or outlets can be adjusted.

In a preferred embodiment, the magnetic constituents present in the dispersion accumulate at least in part, preferably in their entirety, i.e. in a proportion of at least 60% by weight, preferably at least 90% by weight, particularly preferably at least 99% by weight, on the side of the loop-like canal facing the at least one magnet as a result of the magnetic field. This accumulation of the magnetic constituents which is preferred according to the invention results in a compact mass comprising dispersion medium being present on the exterior wall of the loop-like canal space and being moved in one direction by the magnet. However, this mass comprises included nonmagnetic constituents, which, were they to remain there, would lead to certain disadvantages in respect of efficiency and costs, like blockage and costs and downtime connected therewith. As a result of the preferred treatment according to the invention of the magnetic constituents, in particular the compact mass of magnetic constituents present on the exterior wall of the reactor, with a flushing stream, this mass is locally at least partly relayered. Included, nonmagnetic constituents are preferably released in this way. The released, nonmagnetic constituents are preferably transported away with the flushing stream, preferably against the movement of the magnetic constituents, while the magnetic constituents are moved by the magnetic field present.

According to the invention, a "flushing stream" is a stream which comprises neither magnetic constituents, nor nonmagnetic constituents. In a particularly preferred embodiment, the flushing stream is water. However, it can also be any of the abovementioned combinations of water and solvents.

The flushing stream, according to the invention, is preferably added through the at least one second inlet to the stream after the at least one second outlet for the separated magnetic constituents by all methods known to those skilled in the art, for example by means of nozzles, conventional feed lines, nozzles arranged in a ring, perforated plates and membranes and combinations thereof.

The flushing stream can, according to the invention, impinge on the magnetic constituents comprised in the stream from the at least one second outlet for the separated magnetic constituents at any angle which appears to be suitable to a person skilled in the art for a very high flushing action. In a preferred embodiment, the flushing stream meets at the stream at the least one outlet for the separated magnetic constituents at an angle of from 60 to 120°, preferably from 80 to 100°, particularly preferably at right angles. The advantage of this preferred angle is that the greatest possible flushing α-tion is obtained.

In the process of the invention, the magnetic constituents of the dispersion to be treated can be treated with the flushing stream from any direction or side of the reactor space which appears suitable to a person skilled in the art. It is possible, for example, for the flushing stream to be introduced on the side of the loop-like canal on which the magnetic constituents attracted by the magnet are located, preferably as a compact mass. In this embodiment, a particularly high degree of mixing of the compact mass of magnetic constituents is possible. It is also possible according to the invention for the flushing stream to be introduced on the side of the loop-like canal which is opposite the magnetic constituents attracted by the magnet, which are preferably present as a compact mass.

According to the invention, the aqueous dispersion to be treated is preferably conveyed through the loop-like canal space preferably by means of a pump P1. The flushing stream with which the magnetic constituents are treated is preferably conveyed by a pump P2. After the process of the invention has been carried out, the stream comprising the magnetic constituents obtained is preferably conveyed by a pump P3. In a particularly preferred embodiment of the process of the invention, the flushing stream can be divided by the matched pumps P2 and P3, with the volume stream P2 being greater than the volume stream P3. This achieves backflushing of the nonmagnetic constituents at a defined volume flow into stream at the at least one second outlet (stream II).

The present invention further relates to a process for the separation of magnetic constituents from a dispersion comprising these magnetic constituents and nonmagnetic constituents, wherein this dispersion flows through a loop-like canal having at least two inlets and at least two outlets, further comprising at least one magnet that is movable alongside the canal, wherein the canal is arranged relative to gravity in a way that nonmagnetic constituents are assisted to go into the at least one first outlet by sedimentation and by the current of the dispersion and magnetic constituents are forced into at least one second outlet by magnetic force against a current of flushing water.

The general remarks and preferred embodiments as mentioned in respect of the apparatus according to the present invention also relate to the process according to the present invention.

In a preferred embodiment, the present invention relates to the process of the invention, wherein the dispersion to be treated has a solid content of example 3 to 50% by weight.

In a further preferred embodiment, the present invention relates to the process of the invention, wherein the dispersion is an aqueous dispersion.

In a further preferred embodiment, the present invention relates to the process of the invention, wherein the magnetic constituents are selected from the group consisting of magnetic particles, agglomerates of magnetic particles and nonmagnetic constituents and mixtures thereof.

In a further preferred embodiment, the present invention relates to the process of the invention, wherein it is conducted at a temperature of 5 to 60° C., more preferred 10 to 40° C., for example ambient temperature.

The present invention further relates to the use of an apparatus according to the invention for separating magnetic constituents from a dispersion comprising these magnetic constituents and nonmagnetic constituents.

The general remarks and preferred embodiments as mentioned in respect of the apparatus and the process according to the present invention also relate to the use according to the present invention.

In a preferred embodiment, the present invention relates to the use of the invention, wherein the dispersion is an aqueous dispersion.

FIGURES

Figure 1:
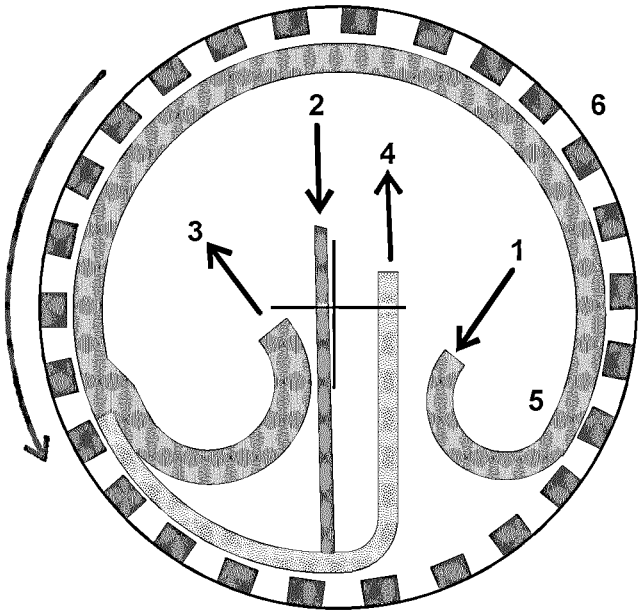
FIG. 1 shows an exemplary apparatus according to the present invention.
Figure 2:
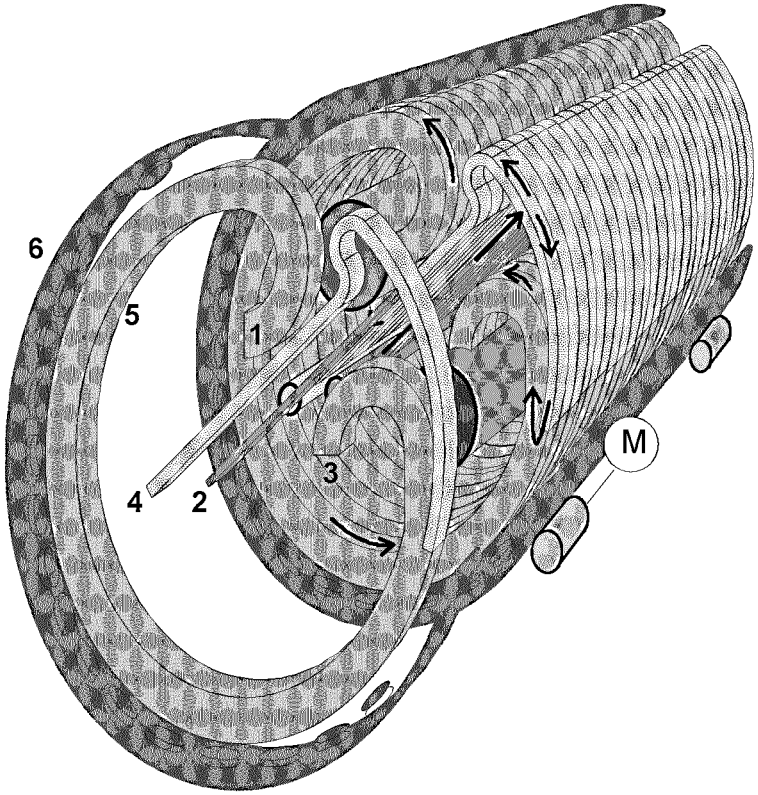
FIG. 2 shows an assembly of a plurality of canals in an apparatus according to the present invention In FIGS. 1 to 8, the numbers have the following meanings.

1 first inlet, through which the dispersion comprising magnetic constituents and non-magnetic constituents, is introduced

2 second inlet, through which the flushing stream is introduced

3 first outlet, through which the dispersion comprising non-magnetic constituents, is left out

4 second outlet, through which the magnetic constituents, are left out

5 canal

6 magnets

Figure 3:
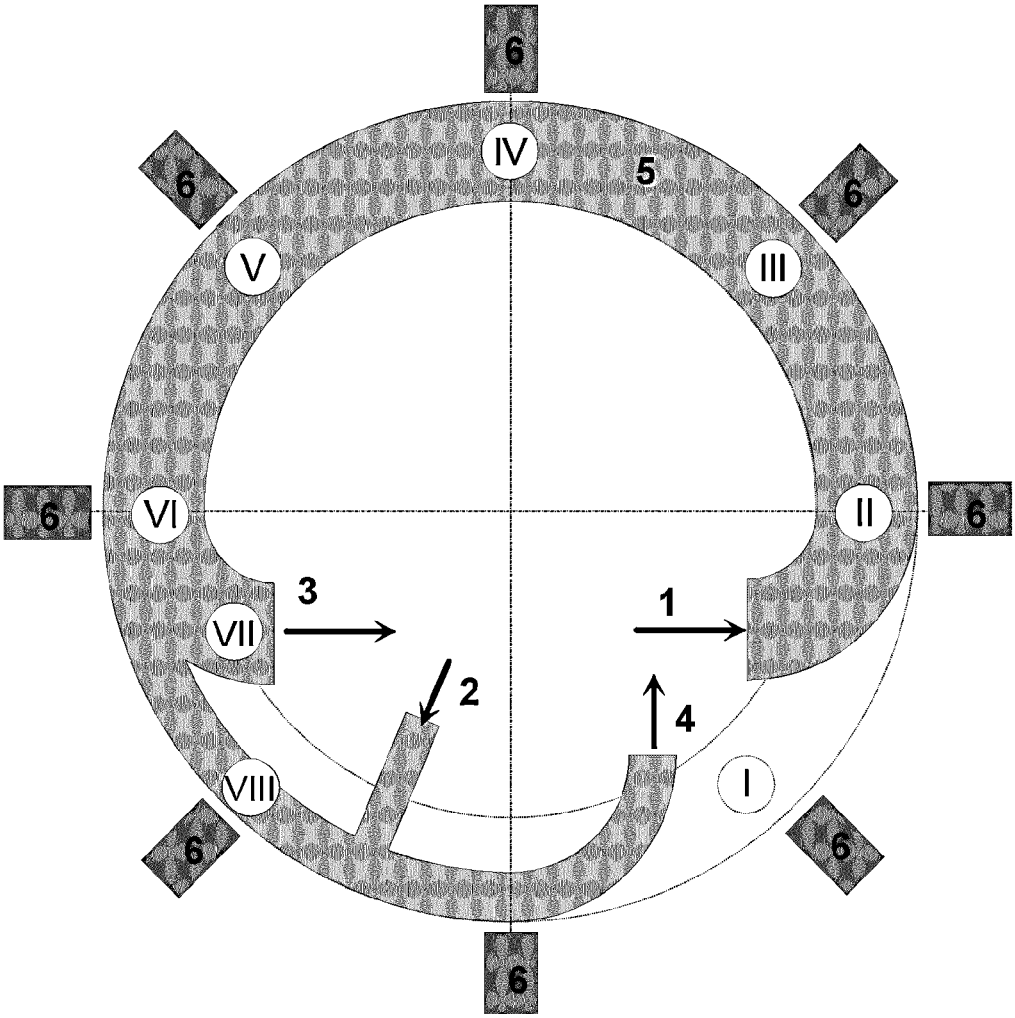
Figure 4:
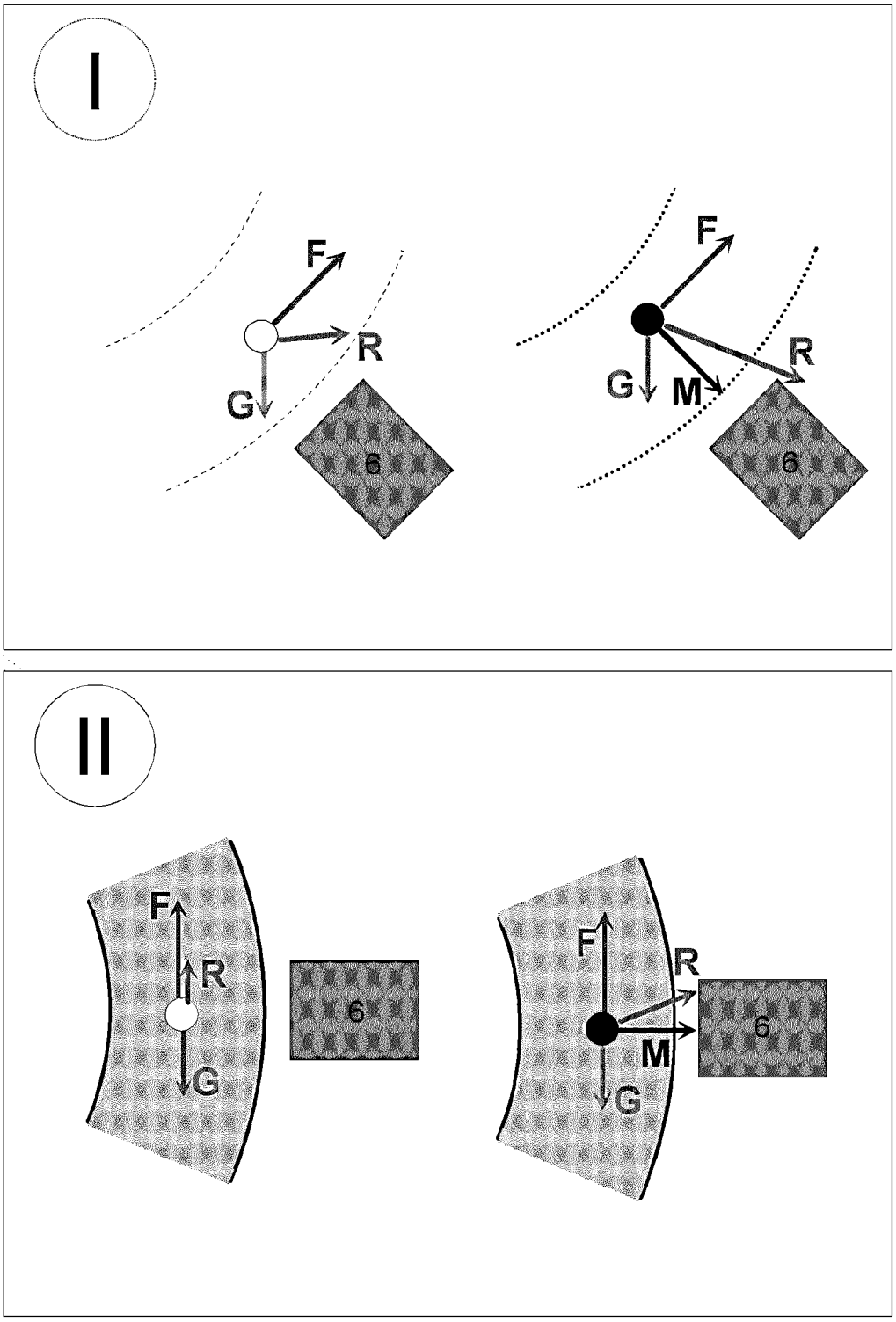
Figure 5:
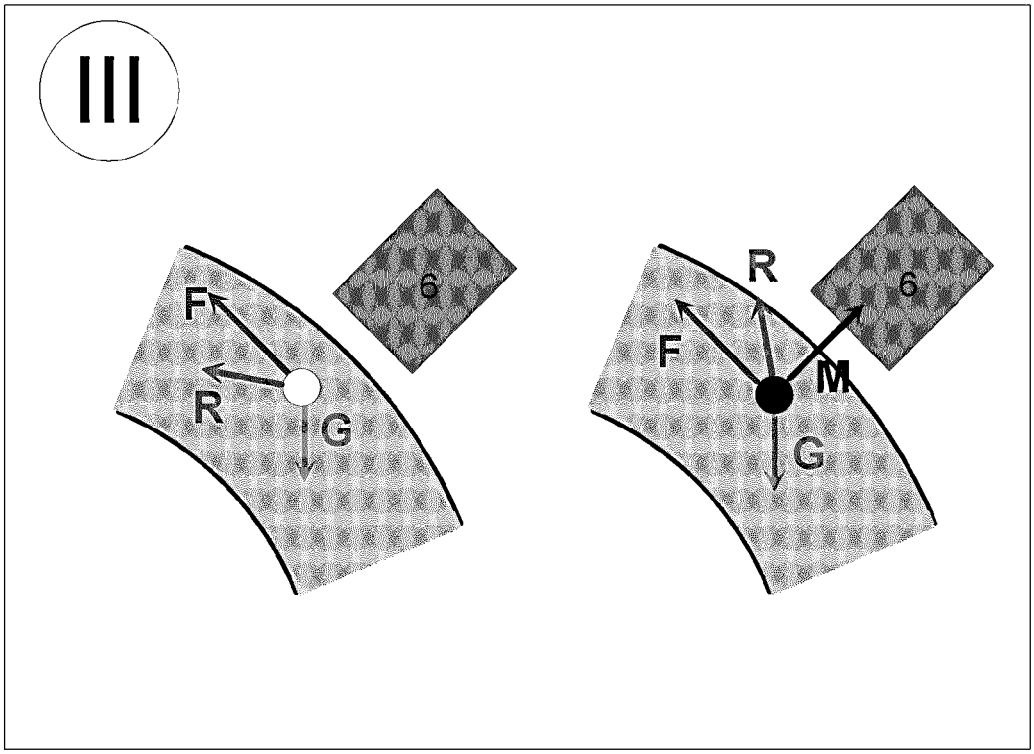
Figure 5:
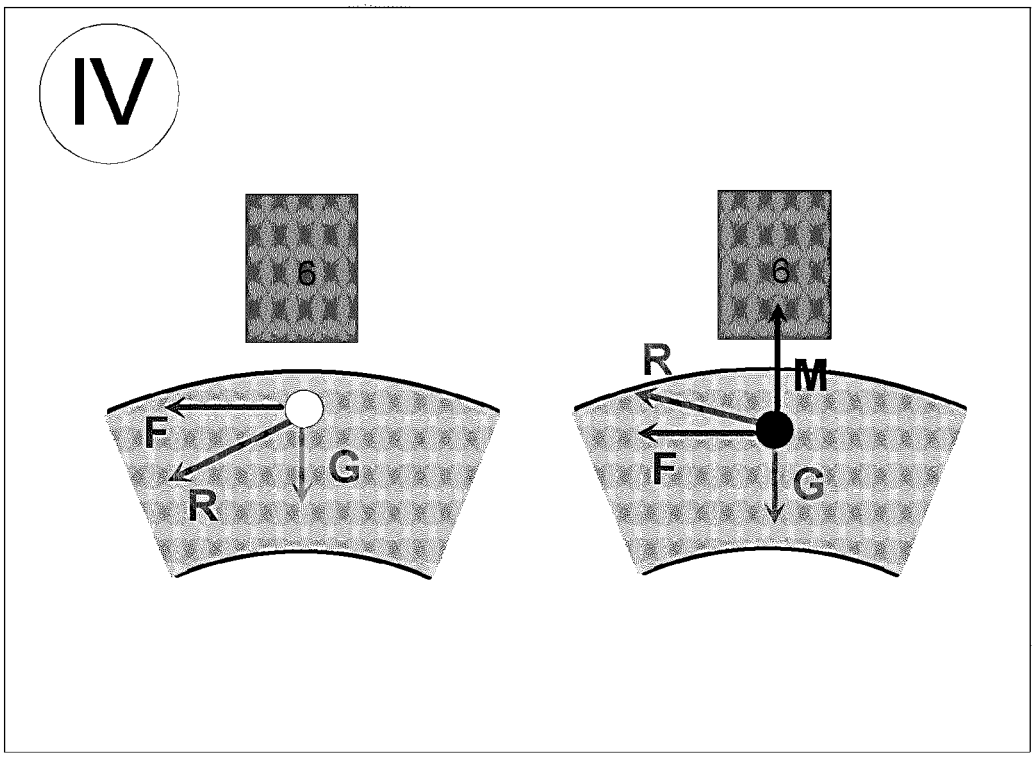
Figure 6:
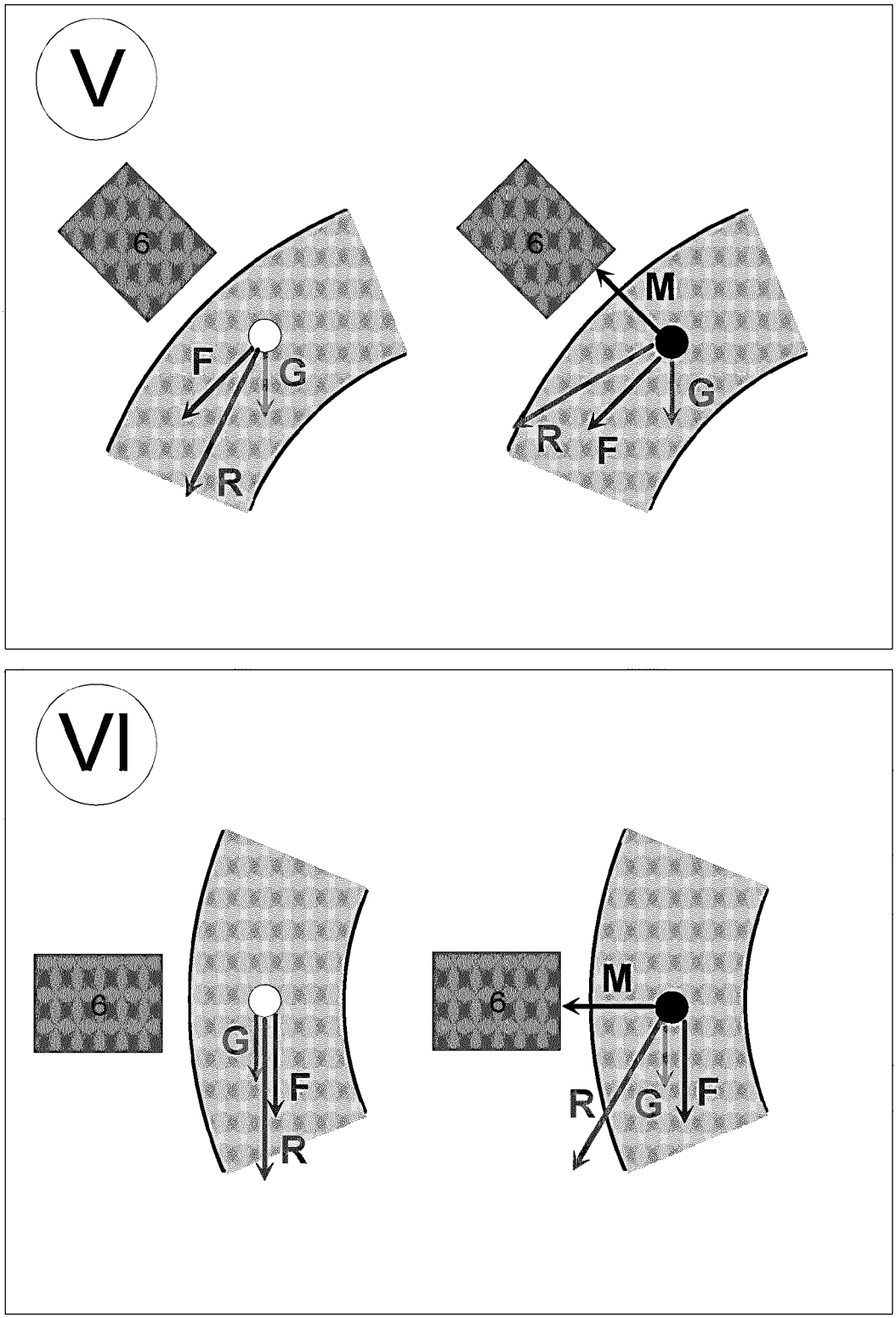
Figure 7:
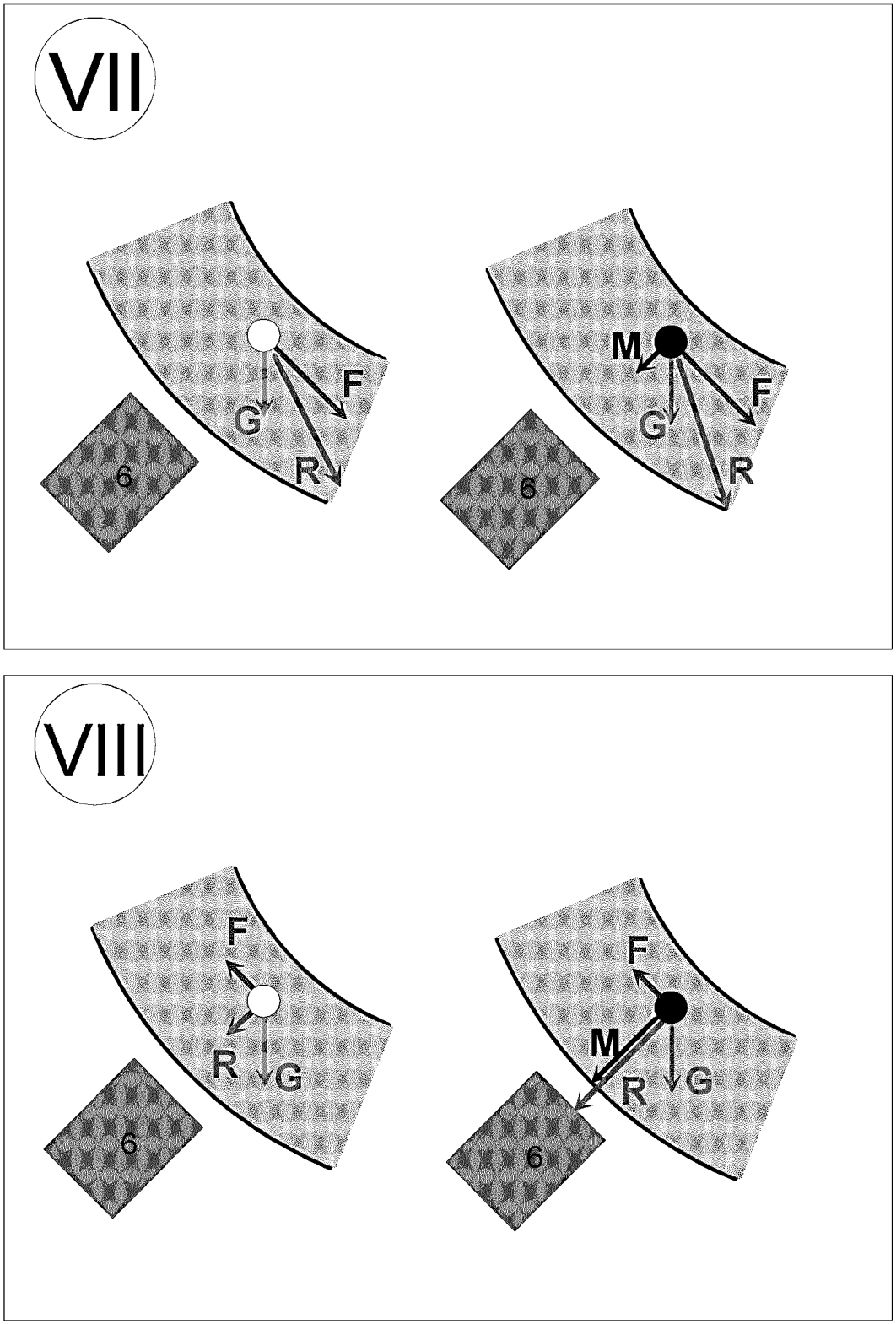
Figure 8:
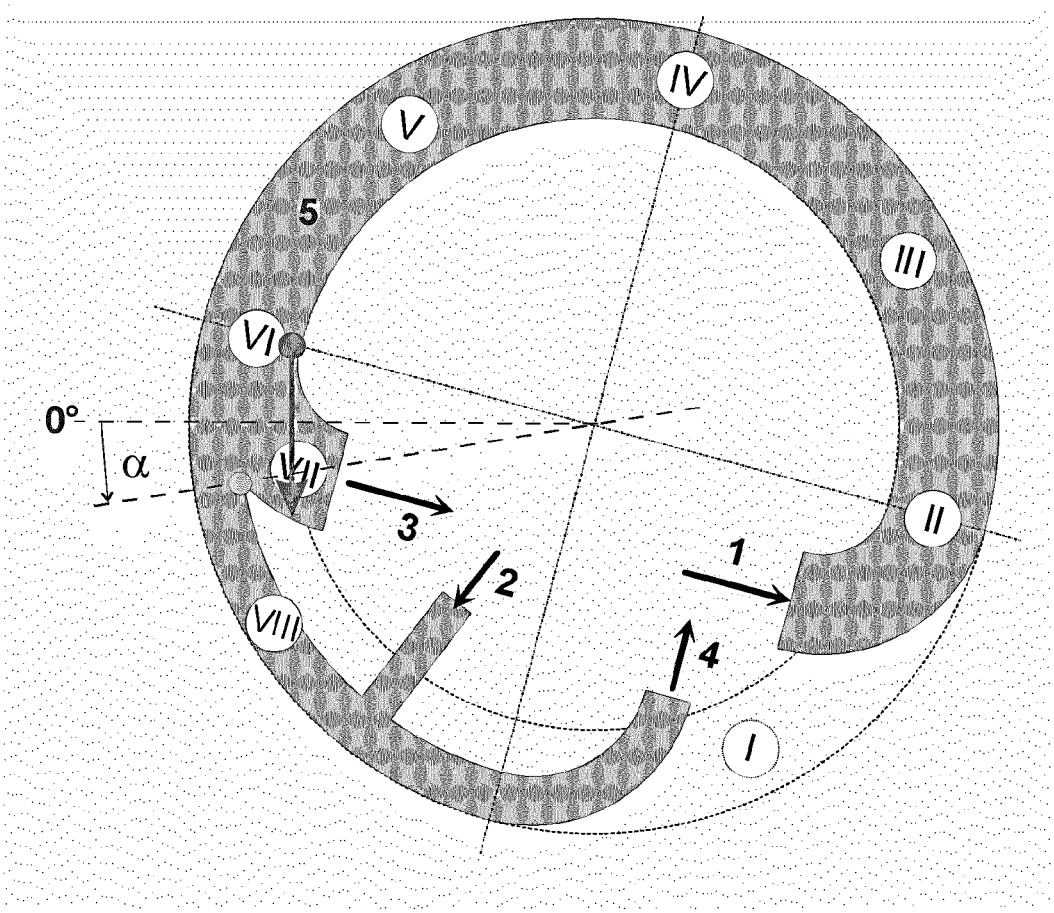

In FIGS. 3 and 8 an exemplary apparatus according to the present invention is shown, wherein sections I to VIII are drawn. Sections I to VIII are shown in FIGS. 2 to 7 in detail. In FIGS. 2 to 7, the balance of forces for the non-magnetic particles is shown on the left side, and the balance of forces for the magnetic particles is shown on the right side, in each case.

In the figures G means force by gravity, F means force by flow, R means resulting force and M means magnetic force.

For example, in FIGS. 3 to 8 show the influence of gravity to the separation of magnetic and non-magnetic particles in different sections of the canal. In section II to VI the gravity assists the movement of non-magnetic particles to the inside wall of the canal, when magnetic particles are forced to move to the outside wall of the canal by magnetic forces of the at least one magnet.

In section I there is no assistance to separate non-magnetic particles. This section normally is not used for separation.

In section VII there is preferably no further separation. It is the outlet of "cleaned" dispersion.

In section VIII only very small non-magnetic particles can be separated by countercurrent flow. Gravity does not assist the separation in this section. Therefore, it is preferred to prevent the settling of big non-magnetic particles to this section. This settling, can be, for example, be prevented by positioning of the first outlet of the canal, as it is exemplary shown in FIG. 8.

EXAMPLES

In order to show that the apparatus and the process according to the present invention can be used to separate magnetic particles from an aqueous dispersion, the following examples have been conducted.

In all examples standard magnets have been used. As magnetic particle, commercially available magnetite has been used, having a diameter in a range of 1-3 μm. The magnetite is sedimented in water building a thin layer at the bottom of a box. These sedimented magnetic particles are moved against gravity to an arrangement of magnets. The distance between the layer of magnetite and the magnets is documented when first movement within the layer is observed and when the layer is fully removed to the magnets. The following results have been obtained:

| size of magnet | | distance | Distance magnet-magnetite [mm] | |
|---|---|---|---|---|
| (diameter · length) [mm · mm] | number of magnets | between [mm] | first effect | magnetite fully removed |
| 5 · 25 | 1 | — | 18 | 16 |
| 10 · 40 | 1 | — | 26 | 24 |
| 30 · 45 | 1 | — | 56 | 54 |
| 5 · 25 | 4 | 5 | 19 | 18 |
| 10 · 40 | 3 | 10 | 30 | 20 |
| 30 · 45 | 2 | 30 | 75 | 65 |

The next example shows the influence of the relation between the flow of dispersion and the movement of the at least one magnet for two different dispersions. Product 1 is an ore that has been milled using balls having a diameter of 2.5 mm, resulting in particles in the dispersion having a d80 of 10.6 micrometer and a d90 of 14.2 micrometer. Product 2 is an ore that has been milled using balls having a diameter of 5.0 mm, resulting in particles in the dispersion having a d80 of 10.7 micrometer and a d90 of 15.1 micrometer.

d80 means that 80% of the particles are smaller than the mentioned value. d90 means that 90% of the particles are smaller than the mentioned value.

The values are obtained using a Mastersizer 2000, software version 5.12G. The sample is dispersed in 2.98% aqueous $Na_4P_2O_7$ solution via ultrasound irradiation with stirring. The measurements of 1 ml sample suspension are carried out for 10 sec under ultrasound irradiation at concentrations of about 0.01%.

The results are shown in the following table. It can be seen that a very good result can be obtained at a relation of 1:1, and that even better results are obtained, when the velocity of the flow is higher than the velocity of the magnet.

| Relation of flow velocity to magnet velocity | Recovery Product 1 [% by weight] | Recovery Product 2 [% by weight] |
|---|---|---|
| 1:1 | 80.7 | 69.9 |
| 2:1 | 83.7 | 78.5 |
| 4:1 | 85.0 | — |

The invention claimed is:

1. An apparatus for the separation of constituents from a dispersion that includes magnetic constituents and nonmagnetic constituents, the apparatus comprising at least one loop-like canal through which the dispersion flows having at least two inlets and at least two outlets, further comprising at least one magnet that is movable alongside the loop-like canal, wherein the canal is arranged relative to gravity so the nonmagnetic constituents are guided to a first outlet by sedimentation and by current flow of the dispersion, and the magnetic constituents are guided to a second outlet by magnetic force and against a current flow of flushing water.

2. The apparatus according to claim 1, wherein the at least one magnet is moved during operation by a rotating device.

3. The apparatus according to claim 1, wherein at least two canals are arranged and operated in parallel.

4. The apparatus according to claim 1, further comprising at least one pump to provide the current flow of the dispersion.

5. The apparatus according to claim 1, wherein the dispersion has a solid content of 3 to 50% by weight.

6. The apparatus according to claim 1, wherein the loop-like canal is arranged vertically with an open end of the loop positioned toward the bottom of the canal.

7. The apparatus according to claim 1, further comprising an edge formed between the at least first outlet and the canal leading the magnetic constituents to the at least second outlet, and the loop is rotated laterally along its perpendicular by −45° to +30°.

8. The apparatus according to claim 1, wherein the current flow of the dispersion and the at least one magnet move in the same direction.

9. The apparatus according to claim 1, wherein the loop-like canal is comprised of bowed rectangular tubes that are fixed to a cylinder having a specification tolerance of diameter of not greater than 3 mm.

10. The apparatus according to claim 1, wherein the current flow of the dispersion and the moving of the at least one magnet alongside the loop-like canal have a relative velocity that is 1:1 to 20:1.

11. A process for the separation of constituents from a dispersion that includes magnetic constituents and nonmagnetic constituents, the process comprising providing a dispersion flow through at least one loop-like canal having at least two inlets and at least two outlets, wherein at least one magnet is movable alongside the at least one loop-like canal, and the canal is arranged relative to gravity so the nonmagnetic constituents are guided to at least one first outlet by sedimentation and by current flow of the dispersion, and magnetic constituents are guided to at least one second outlet by magnetic force and against a current flow of flushing water.

12. The process according to claim 11, wherein the dispersion has a solid content of 3 to 50% by weight.

13. The process according to claim 11, wherein the dispersion is an aqueous dispersion.

14. The process according to claim 11, wherein the magnetic constituents are selected from the group consisting of magnetic particles, agglomerates of magnetic particles and nonmagnetic constituents, and mixtures thereof.

15. The process according to claim 11, wherein the dispersion is maintained a temperature of 5 to 60° C.

* * * * *